US007701422B2

(12) United States Patent
Rolfes

(10) Patent No.: US 7,701,422 B2
(45) Date of Patent: Apr. 20, 2010

(54) ACTIVE MATRIX DISPLAY DEVICE

(75) Inventor: Franciscus P. M. Rolfes, Eindhoven (NL)

(73) Assignee: TPO Hong Kong Holding Limited (TW)

( * ) Notice: Subject to any disclaimer, the term of this patent is extended or adjusted under 35 U.S.C. 154(b) by 890 days.

(21) Appl. No.: 10/598,642

(22) PCT Filed: Feb. 28, 2005

(86) PCT No.: PCT/IB2005/050715

§ 371 (c)(1),
(2), (4) Date: Sep. 7, 2006

(87) PCT Pub. No.: WO2005/091267

PCT Pub. Date: Sep. 29, 2005

(65) Prior Publication Data

US 2007/0182673 A1 Aug. 9, 2007

(30) Foreign Application Priority Data

Mar. 12, 2004 (EP) ..... 04101028

(51) Int. Cl.
*G09G 3/32* (2006.01)

(52) U.S. Cl. ..... 345/82; 345/76

(58) Field of Classification Search ..... 345/76, 345/77, 82, 690; 257/290–292
See application file for complete search history.

(56) References Cited

U.S. PATENT DOCUMENTS

| | | | | |
|---|---|---|---|---|
| 2003/0038760 | A1* | 2/2003 | Kim et al. | 345/76 |
| 2004/0090400 | A1* | 5/2004 | Yoo | 345/76 |
| 2005/0110721 | A1* | 5/2005 | Shin et al. | 345/76 |
| 2005/0122289 | A1* | 6/2005 | Yamazaki et al. | 345/77 |
| 2005/0151705 | A1* | 7/2005 | Fish | 345/76 |
| 2005/0168491 | A1* | 8/2005 | Takahara et al. | 345/690 |

FOREIGN PATENT DOCUMENTS

| | | |
|---|---|---|
| EP | 1130565 | 9/2001 |
| EP | 1282104 | 2/2003 |

* cited by examiner

*Primary Examiner*—Amare Mengistu
*Assistant Examiner*—Koosha Sharifi
(74) *Attorney, Agent, or Firm*—Raymond J. Ho; Morris Manning & Martin

(57) ABSTRACT

The invention relates to an active matrix display device (6) comprising a display panel (2) with a matrix of display pixels (3), and row and column electrodes (11,12) coupled to the display pixels (3). Each of the display pixels (3) has a current mirror circuit adapted to receive a programming current ($I_{prog}$) via the column electrodes (11) and to reproduce the programming current ($I_{prog}$) for driving an emissive element (14). The display device (6) is further arranged to execute a calibration phase wherein a calibration voltage ($V_{cal}$) is applied at each column electrode (11) before the programming current ($I_{prog}$) is applied.

8 Claims, 7 Drawing Sheets

ACTIVE MATRIX DISPLAY DEVICE

Figure 1:
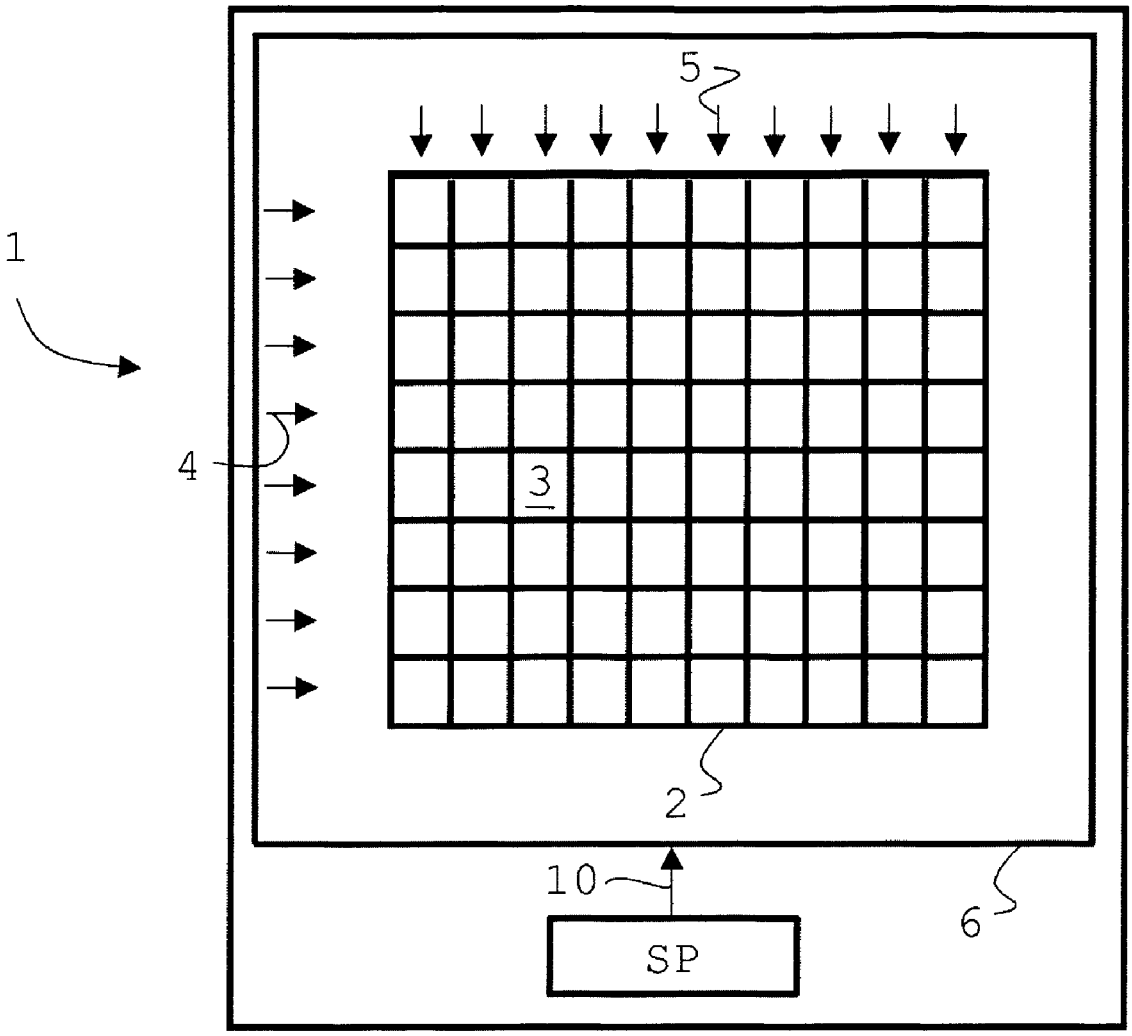

The invention relates to an active matrix display device comprising a display panel with a matrix of display pixels and row and column electrodes coupled to said display pixels, each of said display pixels having a current mirror circuit adapted to receive a programming current via said column electrodes and to reproduce said programming current for driving an emissive element.

US 2001/0052606 discloses a display device comprising a matrix of pixels at the area of crossings of row and column electrodes. The pixels each comprise a current mirror circuit to cope with transistor uniformity issues as a result of differences between drive transistors with respect to the charge carrier mobility and threshold voltage.

The current signals in these types of display devices are very low and the voltages involved show large spreads resulting in the disadvantage of long programming times for the display pixels.

It is an object of the invention to provide a display device, wherein the voltage is well-defined thereby allowing a reduction of the programming time for the display pixels.

This object is achieved by providing an active matrix display device that is further arranged to execute a calibration phase wherein a calibration voltage is applied at each column electrode before said programming current is applied and said calibration voltage is substantially maintained at said column electrode for each of said display pixels until said programming current is applied.

In this way the display device can be controlled such that the column lines are at a well-defined voltage at the moment that the programming current is applied to the display pixels. In other words, the display device is enabled to both apply a calibration voltage to the respective column electrodes and stabilize this calibration voltage for each display pixel along the column electrode. As a result, current programming of the display pixels may be performed faster. This advantage is particularly important for high resolution displays. An additional advantage is that the programming voltage is no longer dependent on the power supply voltage for the display pixel. It is noted that for a color display each of the column electrodes for the red, green and blue display subpixels may be fed with a common calibration voltage that is maintained at the display subpixels until the programming current for that subpixel is applied. It is further noted that the invention does not require that the calibration phase is executed each time that a programming current is applied to a display pixel, although this may be preferable to achieve an optimal effect.

In an embodiment of the invention the display device is arranged for simultaneous execution of said calibration phase for more than one row of said display pixels. In this way loss in addressing time as a result of the calibration phase is reduced or even negligible. If leakage is sufficiently low, the calibration stage can be performed at once for all rows of the display panel. The calibration phase may e.g. be executed each frame time.

In an embodiment of the invention each of said column electrodes or lines is coupled to at least one switch to apply said calibration voltage. This switch may be provided as a separate switch on the display panel, e.g. near the edge, or be implemented in the column driver. In an embodiment of the invention the switch connects said column electrodes to ground to obtain a calibration voltage of zero Volts such that the column line is at this well-defined voltage before application of the programming current. Alternatively a non-zero calibration voltage is applied, which may be advantageous in that a negative power supply voltage for the column driver that contains the programming current sources may be omitted.

In an embodiment of the invention each of said display pixels comprises calibration circuitry having a capacitor and a transistor whose current carrying electrodes are connected between said column electrode and a first plate of said capacitor, and is arranged to charge said capacitor prior to said calibration phase and to discharge during said calibration phase via said transistor such that the gate of said transistor carries a voltage substantially equal to the sum of said calibration voltage and a threshold voltage of said transistor. Such a display device is suited to execute the calibration phase.

In an embodiment of the invention the calibration circuitry comprises one or more switches to control said charging and discharging of said capacitor and the display device comprises a display controller to control said switches, e.g. via the row selection circuit.

In an embodiment of the invention a second plate of the capacitor is connected either to ground or to a substantially constant voltage supply. Preferably the second plate of the capacitor is connected to ground. However, the manufacturing technology employed for the display device may complicate or prevent a connection to ground of this plate, in which case connection to a constant voltage supply is preferred.

In an embodiment of the invention the display device comprises common calibration circuitry to execute said calibration phase for several display pixels along said column electrode. Such an arrangement may save space on the display panel as the calibration circuitry may be shared by some display pixels.

According to an aspect of the invention the product comprises the display device according to the invention and signal processing circuitry. The product may be a handheld device such as a mobile phone, a Personal Digital Assistant (PDA) or a portable computer as well as a device such as a monitor for a Personal Computer, a television set or a display on e.g. a dashboard of a car.

Preferably the display panel is a high resolution display panel as especially for such display panels the invention reduces or eliminates the effects of the voltage drop over the power lines for the display pixels. Further, the column line capacity is larger for such displays.

The invention also relates to a method for calibrating an active matrix display device comprising a display panel with a matrix of display pixels, and row and column electrodes coupled to said display pixels, each of said display pixels comprising a current mirror circuit adapted to receive a programming current via said column electrodes and to reproduce said programming current for driving an emissive element, comprising the steps of:

applying a calibration voltage to each column electrode before said programming current is applied;

substantially maintaining said calibration voltage at said column electrode until said programming current is applied.

The method results in a faster current programming for the display pixels as the column electrode is at a well-defined voltage at the moment of applying the programming current.

In an embodiment of the invention the calibration voltage is applied for more than one row of said display panel at once. Preferably the calibration stage is performed for the entire display at once, such that loss of addressing time is minimal.

The invention will be further illustrated with reference to the attached drawings, which show a preferred embodiment according to the invention. It will be understood that the invention is not in any way restricted to these specific and preferred embodiments.

Figure 2:
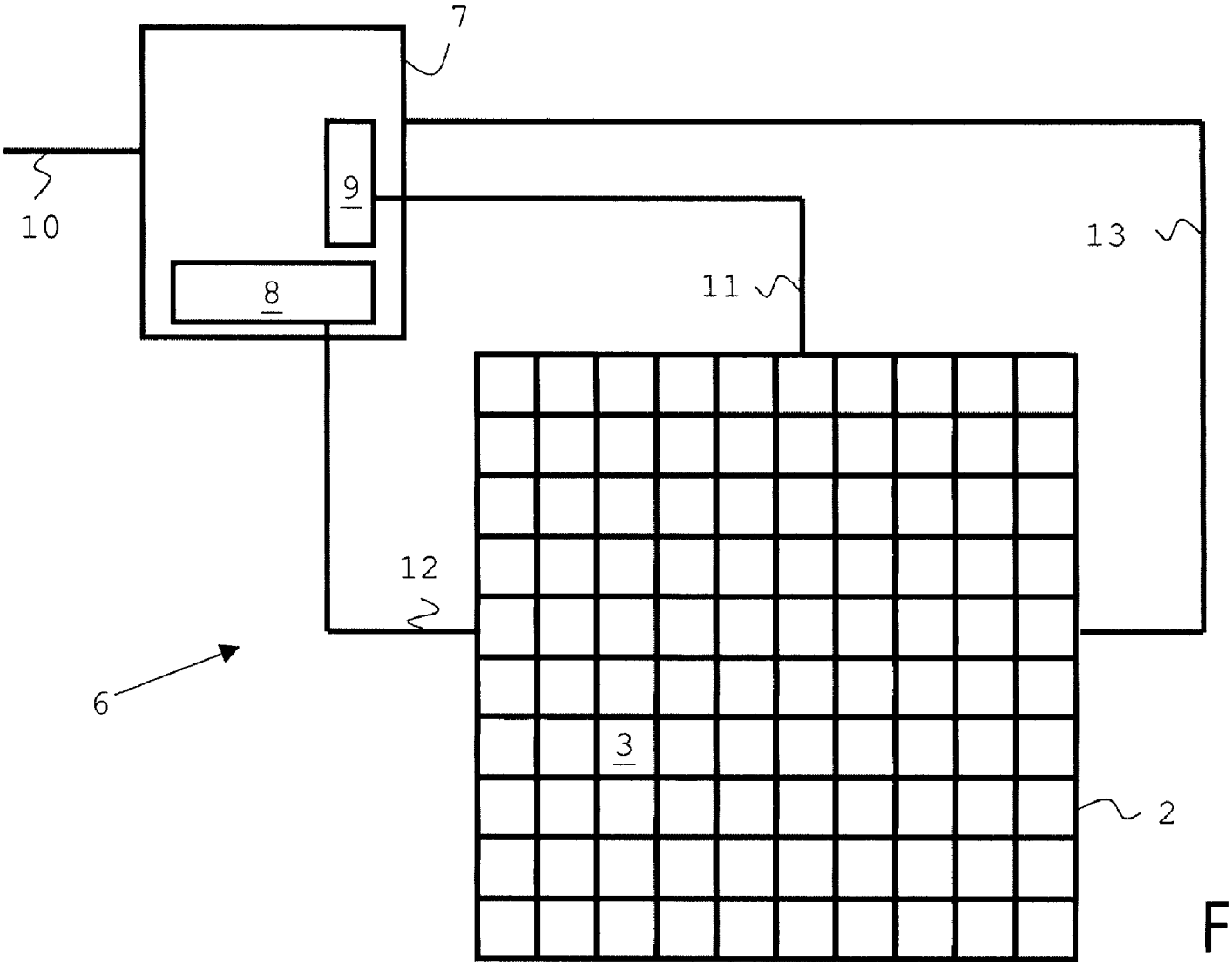
Figure 3:
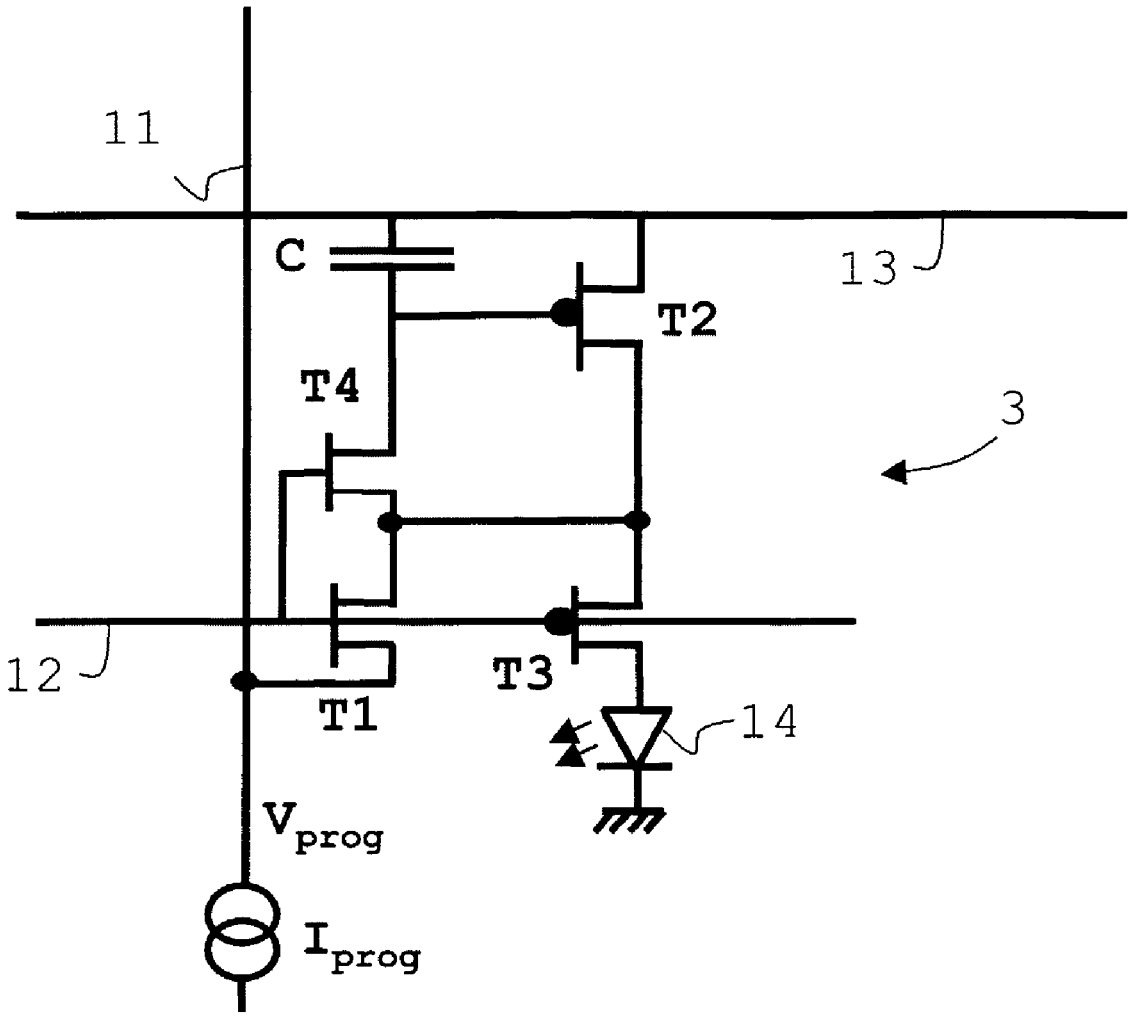
Figure 4:
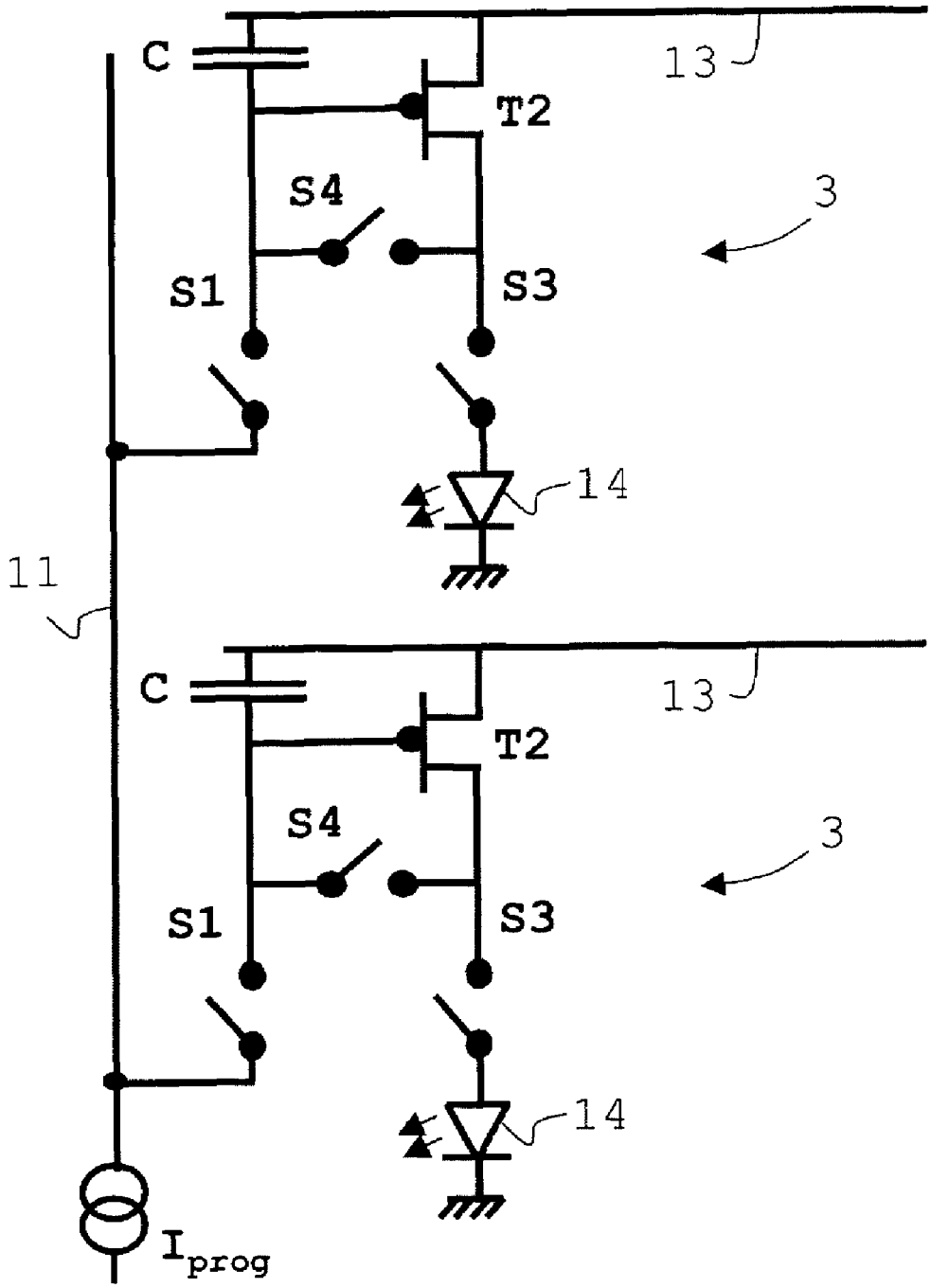
Figure 5:
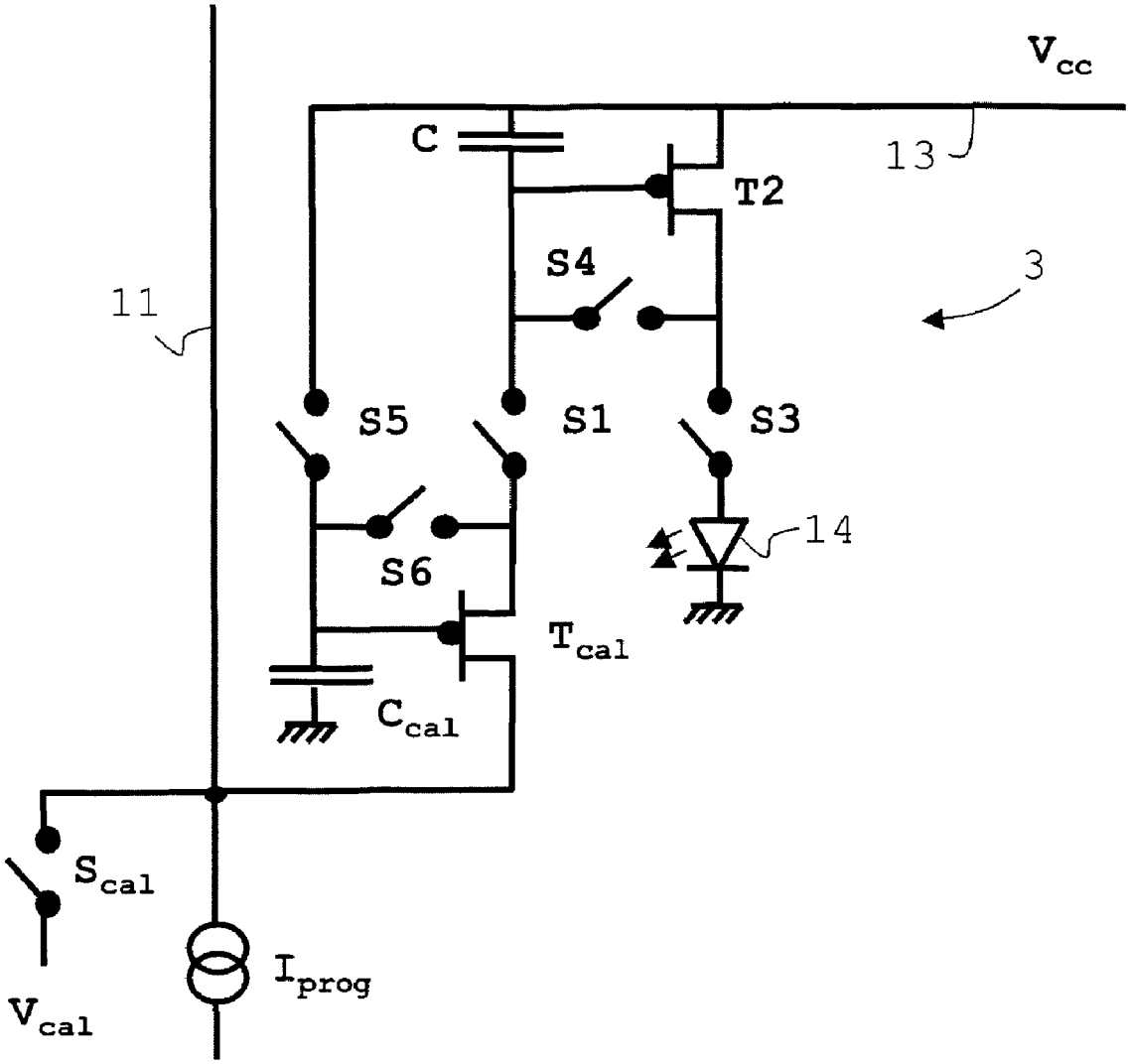
Figures 6A, 6B, 6C:
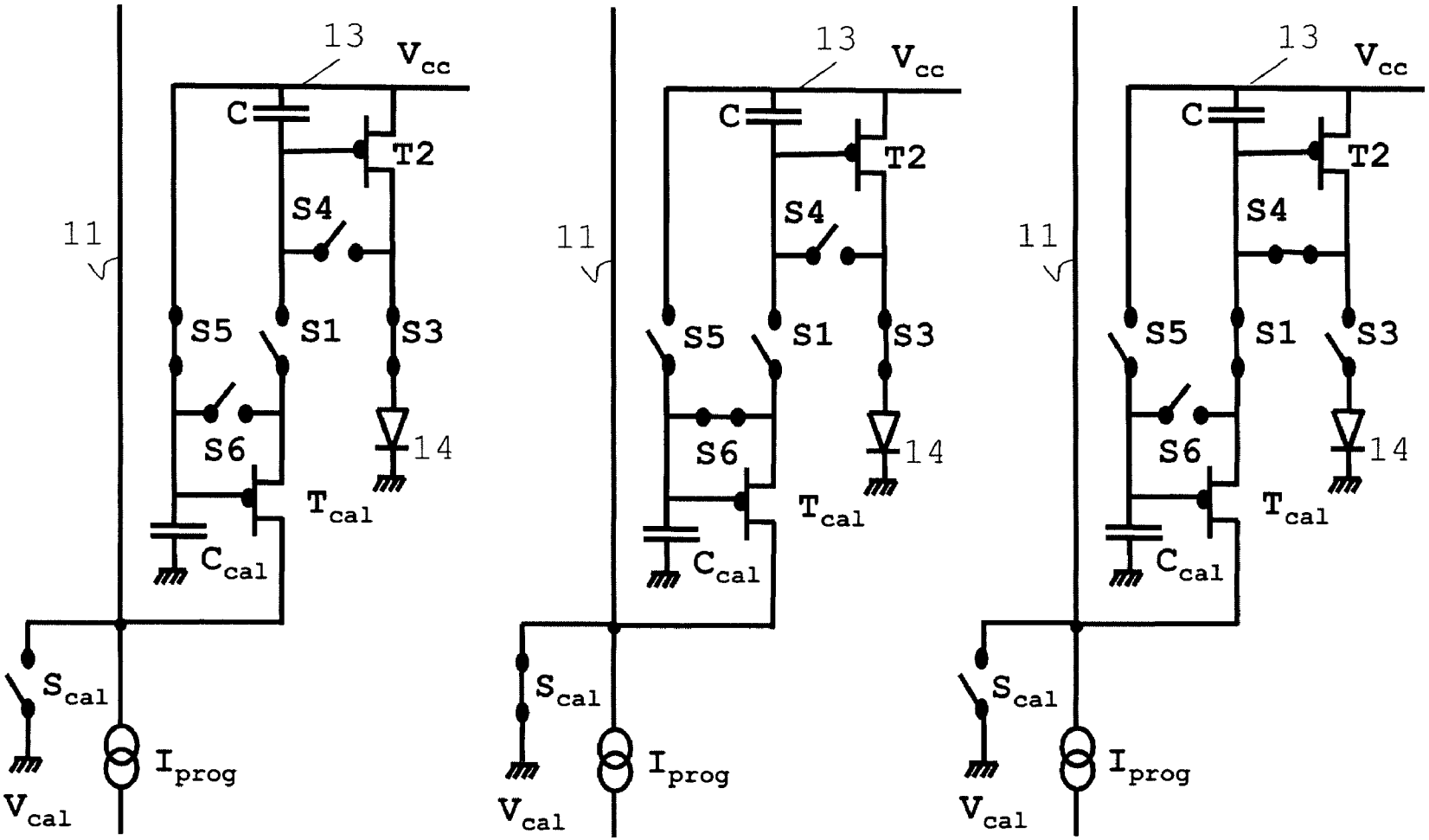
Figure 7:
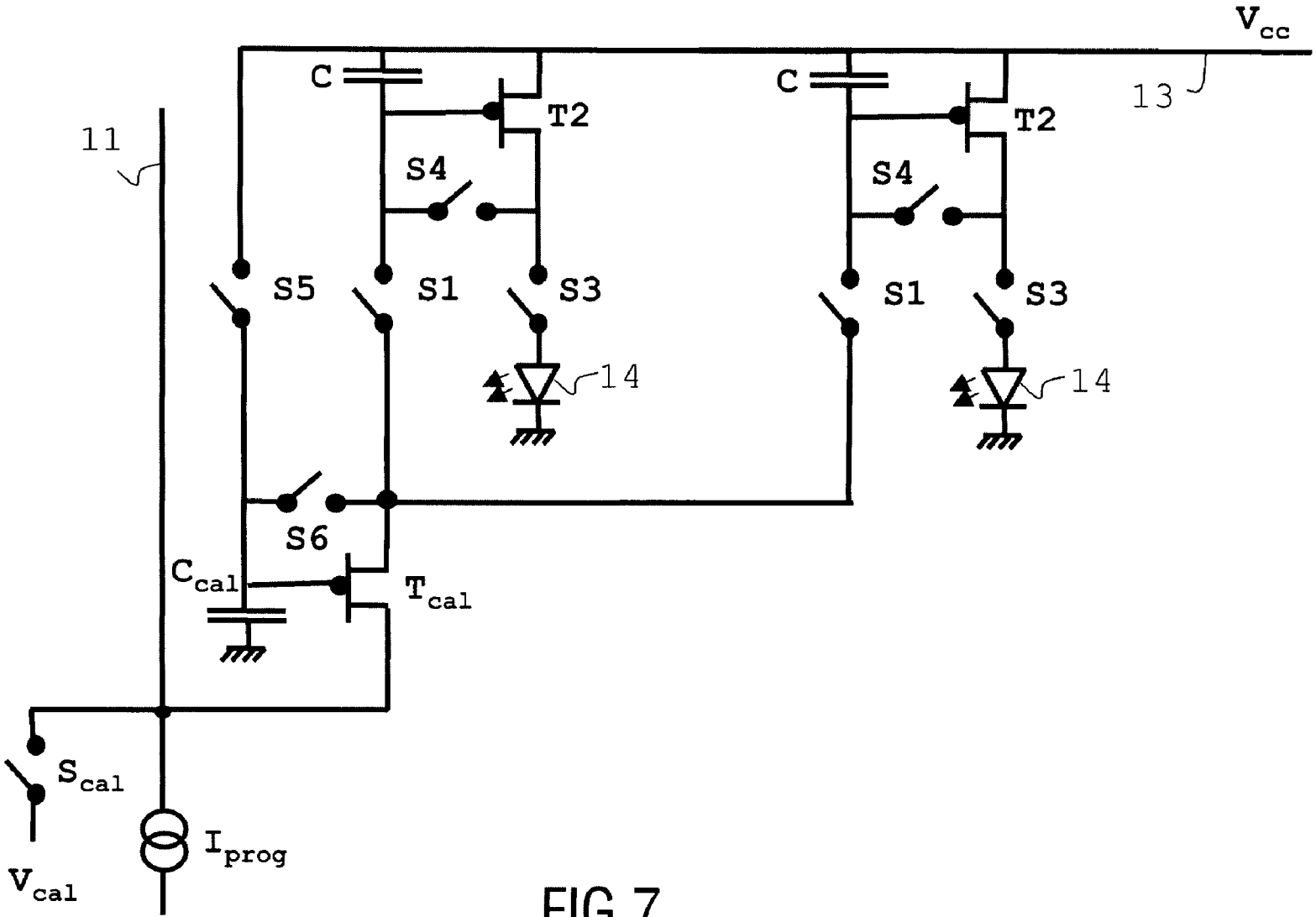

In the drawings:

FIG. 1 shows a product comprising an active matrix display device,

FIG. 2 shows a schematical illustration of an active matrix display device shown in FIG. 1, FIG. 3 shows a current programmable current mirror display pixel for a display device as shown in FIG. 2, FIG. 4 shows two display pixels as shown in FIG. 3 along a column electrode of the display device as shown in FIG. 2, FIG. 5 shows a part of an active matrix display device incorporating a display pixel according to an embodiment of the invention, FIGS. 6A-6C show various stages in the operation of the active matrix display device according to an embodiment of the invention; and FIG. 7 shows an alternative embodiment for the active matrix display device according to the invention.

FIG. 1 shows a product 1 comprising an active matrix display device 6 and signal processing circuitry SP. The display device 6 comprises an active matrix display panel 2 having a plurality of display pixels 3 arranged in a matrix of rows 4 and columns 5. The display panel 2 is an active matrix display comprising display pixels 3 containing polymer light emitting diodes (PLEDs) or small molecule light emitting diodes (SMOLEDs). The display panel 2 may be a high resolution display panel as the available programming times in such display panels are very small.

The product 1 may be a television receiver, in which case the signal processing circuitry SP may include circuitry for receiving a television signal and converting the television signal into a format for driving a data input 10 of the display device 6. Alternatively, the product 1 may be a handheld device such as a mobile phone or a PDA, a portable computer or a monitor for a personal computer or any other product with a display device. In these cases the signal processing circuitry SP may include data processing circuitry.

FIG. 2 shows a schematical illustration of an active matrix display device 6, comprising a PLED display panel 2 of the product 1 as shown in FIG. 1 having current emissive elements. The display device 6 comprises a display controller 7, including amongst others a row selection circuit 8 and a column driver 9. A data signal, comprising information or data such as for (video) images to be presented on the display panel 2, is received via data input 10 by the display controller 7. The data are written as programming currents to the appropriate display pixels 3 via the column driver 9 and data lines 11. The selection of the rows 4 of display pixels 3 is performed by the row selection circuit 8 via selection lines 12, controlled by the display controller 7. Synchronization between selection of the rows 4 of display pixels 3 and writing of the data to the display pixels 3 is performed by the display controller 7. Moreover the display controller 7 may control the power supply of the display pixels 3 via power line 13.

FIG. 3 shows a current programmable display pixel 3 in a current mirror configuration for a display panel 2 shown in FIG. 2. A driving transistor T2 is used in both programming the display pixel 3 and in driving an emissive element 14, such as a PLED element. The application of the programming current over the data line 11 is indicated by the current source $I_{prog}$. During the programming period a transistor T4 connects a capacitor C with a current carrying electrode of the driving transistor T2 while the emissive element 14 is isolated from the driving transistor T2 by a transistor T3. During this programming phase the data input programming current is forced through T2 while the capacitor C is charged or discharged depending on the previously programmed value to reach the associated gate-source voltage $V_{GS}$ for T2. Now, by opening T1 and T4 and by closing T3, the drain current of the driving transistor T2 is fed to the emissive element 14. The memory function of the capacitor C assures that the current is a perfect copy of the programming current signal received over line 11.

The current I through the driving transistor T2 is:

$$I=I_{prog}=\mu(V-Vt)^2$$

wherein μ is the mobility of the charge carriers, Vt the threshold voltage of the driving transistor T2 and V the gate-source voltage of the driving transistor T2. It is assumed here that the current I from the driving transistor T2 is indeed identical to the programming current $I_{prog}$, which is a reasonable assumption for a display pixel 3 with a current mirror circuit. The programming voltage $V_{prog}$ representing the voltage that results from the application of the programming current $I_{prog}$ therefore yields:

$$V_{prog}=V_{cc}-Vt-\sqrt{(I_{prog}/\mu)}$$

wherein $V_{cc}$ is the voltage supplied over the power line 13. The current mirror circuit of the display pixel 3 shown in FIG. 3 has the advantageous feature that at low frequencies, despite differences in mobility μ and threshold voltages Vt of the driving transistors between the various display pixels 3, the current through the emissive element is an almost exact copy of the received programming current.

FIG. 4 shows two display pixels 3 as shown in FIG. 3 of all the display pixels 3 along the column electrode 11 of the display panel 2. For reasons of clarity the transistors T1, T3 and T4 have been drawn as switches S1, S3 and S4. The mobilities μ and threshold voltages Vt of the driving transistors T2 determine the voltage $V_{prog}$ on the column electrode 11 as the display pixel circuits stabilize for a given programming current $I_{prog}$. As the transistors T2 are not identical with respect to the mobility and threshold voltage, the voltage $V_{prog}$ will differ significantly. When the lower display pixel 3 is programmed with a first programming current $I_{prog}$, the corresponding switch S1 is closed and the voltage $V_{prog}$ at the column electrode 11 will stabilize at a certain value depending on the first programming current and the characteristics of T2 of this display pixel 3. If subsequently the upper display pixel 3 is programmed, S1 of the lower display pixel 3 opens while S1 of the upper display pixel 3 is closed. Even when the programming current is the same as for the lower display pixel 3, the voltage $V_{prog}$ is likely to stabilize at a different value compared to the voltage for the lower display pixel 3 because the characteristics of the driving transistor T2 of the upper display pixel 3 are presumably different from those of the driving transistor T2 of the lower display pixel 3.

The programming currents $I_{prog}$ are typically low, i.e. in the order of nanoamperes in the dark region to microamperes at full brightness of the emissive element 14. The line capacitance of the column electrode 11 may be in the order of 100 pF. Thus for a difference in the programming voltage $V_{prog}$ of 1 Volt between the upper and lower display pixel 3, a programming current of 10 nanoamperes results in a period of 10 milliseconds to bring the column electrode 11 to the required voltage $V_{prog}$. Such long stabilization times limit operation of the display panel 2 at high frequencies. For high resolution displays 2 the capacitance of the column electrode 11 increases, thereby yielding worse performance. Further, the trend to use higher resolutions results in a decrease of the programming currents for each display pixel 3.

FIG. 5 shows a part of an active matrix display device 6 incorporating a display pixel 3 according to an embodiment of the invention. The display pixel 3 comprises circuitry identical to that shown in FIG. 4. Identical reference numerals indicate similar components of the circuitry in the display pixels 3. The display pixel 3 further comprises calibration circuitry including switches S5 and S6, a capacitor $C_{cal}$ and a transistor $T_{cal}$. The capacitor $C_{cal}$ has one plate connected to ground and the other plate connected to the gate of the transistor $T_{cal}$. This plate and the gate of the transistor $T_{cal}$ are connected via the switch S5 to the voltage $V_{cc}$ of the power line 13. Further this plate and the gate of $T_{cal}$ are connected to a current carrying electrode of the transistor $T_{cal}$ via the switch S6. This current carrying electrode is further connected to the current mirror circuit of the display pixel 3 shown in FIG. 3. The other current carrying electrode of the transistor $T_{cal}$ is connected to the column electrode 11. The switches S5 and S6 may be controlled by the display controller 7 via the row selection circuit via selection lines 12 (not shown in FIG. 5) as are the other switches. It should be appreciated that switches S5 and S6 can be implemented as transistors in the display pixel 3 according to the invention.

It is further noted that the capacitor $C_{cal}$ is not necessarily connected to ground, although this is a preferred arrangement. Instead the capacitor plate may be connected to a substantially stable voltage, such as $V_{cc}$.

Further the column electrode 11 is connected to a voltage $V_{cal}$ via a switch $S_{cal}$.

An example of the operation of the active matrix display device 6 shown in FIG. 5 is provided in FIGS. 6A-6C.

In FIG. 6A the display pixel 3 is not programmed and the voltage over the capacitor C may cause T2 to drive the current emissive element 14. It should be appreciated that the invention does not require that light is emitted from the emissive element 14. The switch S5 is closed such that $C_{cal}$ is charged to a level equal to $V_{cc}$ saturating the calibration transistor $T_{cal}$ prior to the calibration phase. However, as S1 and S6 are open, no current flows through $T_{cal}$.

FIG. 6B shows an example for the implementation of the calibration phase. Still switch S1 is open such that the display pixel 3 is not programmed by charging the capacitor C. In this calibration phase the switch $S_{cal}$ is closed applying a calibration voltage $V_{cal}$ of e.g. 0 Volts to the column electrode 11. Further switch S6 is closed leading to a discharge of the calibration capacitor $C_{cal}$ resulting in a current through the switch S6 and the transistor $T_{cal}$. The gate voltage of $T_{cal}$ will decrease until $T_{cal}$ stops conducting, the gate voltage then yielding the threshold voltage Vt of the transistor $T_{cal}$. At this moment the voltage of the column electrode 11 is well-defined at 0 Volts. This calibration voltage is substantially maintained at the column electrode 11 for each display pixel 3 until the current signal $I_{prog}$ is applied in the programming phase as illustrated in FIG. 6C.

It should be appreciated that if $V_{cal}$ is set at a non-zero voltage V1, $T_{cal}$ will stop conducting if the gate voltage equals Vt+V1. If $V_{cal}$ is chosen to have a non-zero value V1, the column driver 9 can be implemented without a negative voltage supply. Such a supply may be required if the column driver(s) 9 is to absorb currents at zero volts on the column electrode 11.

It should further be appreciated that during the calibration phase the emissive element 14 may still emit light as programmed in a prior programming phase.

FIG. 6C illustrates the programming phase wherein the display pixel 3 is programmed by charging the capacitor C to the adequate voltage. Accordingly, switches S1 and S4 are closed and switch S3 is opened. Further the switch $S_{cal}$ is opened to allow the programming current to flow into the display pixel 3 of the column electrode 11. The capacitor $C_{cal}$ ensures maintenance of the voltage on the column electrode 11 after opening of the switch $S_{cal}$. As S5 and S6 are opened the gate voltage of the calibration transistor $T_{cal}$ will not change and is fixed at the threshold voltage Vt. The programming current will flow through $T_{cal}$, S1 and S4 such that the voltage over the capacitor C increases or decreases to a value where the current through the driving transistor T2 is equal to the programming current $I_{prog}$.

It is noted that the switches S1 and S6 are open for the non-programmed display pixels 3 along the column electrode 11 as displayed e.g. in FIG. 6A. The states of the other switches S3, S4 and S5 are not essential for the invention. If e.g. a non-addressed display pixel 3 is to emit light, switch S3 is closed and switch S4 is open. If the display pixel 3 should not emit light for a particular percentage of the frame time when it is not addressed, i.e. a reduced duty cycle applies, the switch S3 should be open for this percentage of the frame time.

The calibration phase described above is executed rowwise for each column 5. However, it is advantageous to execute the calibration phase for more than one row 4 of display pixels 3 at a time or even for the whole display panel 2 at once. The latter option requires the charge on $C_{cal}$ to be sufficiently stable, i.e. no or negligible leakage, over the relevant period of time, i.e. the time during which the calibration voltage $V_{cal}$ should be maintained for the display pixel 3. The initiation of the calibration phase for one or more rows 4 can be controlled from the display controller 7.

The result of the calibration phase is that the display pixels 3 can be quickly current programmed as a result of the reduced voltage swing. Only in extreme cases the voltage swing on the column electrode 11 may be a few volts. Typically if the programming current increases from 1 nanoampere to 1 microampere, the voltage swing is a few millivolts which is considerably less than in the prior art display devices. As a consequence display panels 2 with higher resolutions can be applied. Further, the programming voltage $V_{prog}$ is no longer dependent on the voltage $V_{cc}$ of the power line 13. The gist of the invention is that the modified display pixel circuit features a well-defined input voltage that is independent of the spread in the characteristics of the driving transistors T2 between the various display pixels 3 on the display panel 2. The considerable reduction of the voltage swing on the column electrodes 11 enhances the current programming speed such that displays with higher resolutions can be operated. A disadvantage of the active matrix display device 6 according to the invention is the increase in the area accommodated by circuitry for each display pixel 3 which is detrimental for the aperture of the display pixel. However, for top emission display panels 2, wherein the light of the emissive element 14 is emitted away from the display pixel circuitry, this is not an issue.

The purpose of the calibration circuitry in the display pixel 3 is to deal with the variation in the threshold voltages of the driving transistor T2 in the display pixel 3 itself such that the long column electrode 11 does not experience such a variation. The variation however is still present between $T_{cal}$ and T2 in the display pixel. In this part such a variation is less or not harmful because of the low line capacity. As the line capacitance is relatively low, the use of a single calibration circuit for more than one display pixel 3 at the same column electrode 11 is possible, as shown in FIG. 7. In this embodiment, the line capacity is slightly higher compared to the arrangement wherein each display pixel or display subpixel has a dedicated calibration circuitry, since this capacity is increased by the line distance between $T_{cal}$ and S1 of the different display pixels 3. However this line capacity is still significantly lower than that of the column electrode 11.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. Active matrix display device (6) comprising a display panel (2) with a matrix of display pixels (3), and row and column electrodes (11,12) coupled to said display pixels (3), each of said display pixels (3) having a current mirror circuit adapted to receive a programming current ($I_{prog}$) via said column electrodes (11) and to reproduce said programming current ($I_{prog}$) for driving an emissive element (14), wherein said display device (6) is further arranged to execute a calibration phase wherein a calibration voltage ($V_{cal}$) is applied at each column electrode (11) before said programming current ($I_{prog}$) is applied and said calibration voltage is substantially maintained at said column electrode (11) for each of said display pixels (3) until said programming current ($I_{prog}$) is applied, and wherein each of said display pixels (3) further comprises calibration circuitry having a capacitor ($C_{cal}$) and a transistor ($T_{cal}$) whose current carrying electrodes are connected between said column electrode (11) and a first plate of said capacitor ($C_{cal}$), and is arranged to charge said capacitor ($C_{cal}$) prior to said calibration phase and to discharge during said calibration phase via said transistor ($T_{cal}$) such that the gate of said transistor ($T_{cal}$) carries a voltage substantially equal to the sum of said calibration voltage ($V_{cal}$) and a threshold voltage (Vt) of said transistor ($T_{cal}$).

2. Active matrix display device (6) according to claim 1, wherein said display device (6) is arranged for simultaneous execution of said calibration phase for more than one row (4) of said display pixels (3).

3. Active matrix display device (6) according to claim 1, wherein each of said column electrodes (11) is coupled to at least one switch ($S_{cal}$) to apply said calibration voltage ($V_{cal}$).

4. Active matrix display device (6) according to claim 3, wherein said switch ($S_{cal}$) connects said column electrodes (11) to ground.

5. Active matrix display device (6) according to claim 1, wherein said calibration circuitry comprises one or more switches (S5, S6) to control said charging and discharging of said capacitor ($C_{cal}$)) and wherein said display device (6) comprises a display controller (7) for controlling said switches (S5,86).

6. Active matrix display device (6) according to claim 1, wherein a second plate of said capacitor ($C_{cal}$) is connected either to ground or to a substantially constant voltage supply.

7. Active matrix display device (6) according to claim 1, wherein said display device (6) comprises common calibration circuitry to execute said calibration phase for several display pixels (3) along said column electrode (11).

8. A product (1) comprising the active matrix display device (6) as claimed in claim 1; and signal processing circuitry (SP) for supplying a signal to the active matrix display device (6).

* * * * *